US010524619B2

(12) United States Patent
LeMay

(10) Patent No.: US 10,524,619 B2
(45) Date of Patent: Jan. 7, 2020

(54) ADJUSTABLE HOT TUB SEATING DEVICE

(71) Applicant: Jason LeMay, Newton, NH (US)

(72) Inventor: Jason LeMay, Newton, NH (US)

( * ) Notice: Subject to any disclaimer, the term of this patent is extended or adjusted under 35 U.S.C. 154(b) by 0 days.

(21) Appl. No.: 15/953,958

(22) Filed: Apr. 16, 2018

(65) Prior Publication Data

US 2018/0303290 A1 Oct. 25, 2018

Related U.S. Application Data

(60) Provisional application No. 62/489,059, filed on Apr. 24, 2017.

(51) Int. Cl.

| | |
|---|---|
| ***A47K 3/12*** | (2006.01) |
| ***A61H 33/00*** | (2006.01) |
| ***A61H 99/00*** | (2006.01) |
| ***A61H 35/00*** | (2006.01) |

(52) U.S. Cl.

CPC ..... *A47K 3/122* (2013.01); *A47K 3/125* (2013.01); *A61H 33/60* (2013.01); *A61H 33/6089* (2013.01); *A61H 99/00* (2013.01); *A61H 2035/004* (2013.01); *A61H 2201/0115* (2013.01); *A61H 2201/0149* (2013.01); *A61H 2201/0196* (2013.01); *A61H 2201/1623* (2013.01); *A61H 2201/5051* (2013.01); *A61H 2201/5053* (2013.01); *A61H 2203/02* (2013.01); *A61H 2203/0456* (2013.01); *A61H 2203/0462* (2013.01)

(58) Field of Classification Search

CPC ..... A47K 3/122
USPC ..... 4/579
See application file for complete search history.

(56) References Cited

U.S. PATENT DOCUMENTS

| | | | | | |
|---|---|---|---|---|---|
| 4,037,591 | A * | 7/1977 | Sarno | A61H 7/001 | 4/573.1 |
| 4,237,561 | A * | 12/1980 | Britton | A47K 3/022 | 4/546 |
| 4,821,348 | A * | 4/1989 | Pauna | A61G 7/0005 | 4/547 |
| 5,172,433 | A * | 12/1992 | Lake | A47K 3/022 | 4/541.4 |
| 5,448,787 | A * | 9/1995 | Allen | A47K 3/10 | 4/541.1 |
| 5,535,458 | A * | 7/1996 | Siverly | A47K 3/122 | 4/573.1 |
| 2004/0098801 | A1* | 5/2004 | Sherlock | A61G 7/1003 | 4/579 |
| 2006/0272085 | A1* | 12/2006 | Hribsek | A47K 3/122 | 4/579 |

* cited by examiner

*Primary Examiner* — Lori L Baker
(74) *Attorney, Agent, or Firm* — Hayes Soloway PC

(57) ABSTRACT

Adjustable seating devices for use in a hot tub may include multiple panels that move relative to one another and/or relative to the hot tub frame to adjust between positions. In some embodiments, one or more panels of the adjustable seating device may include jets. The adjustable seating devices may be adjusted manually, hydraulically, air-actuated, or electronically.

15 Claims, 10 Drawing Sheets

ADJUSTABLE HOT TUB SEATING DEVICE

BACKGROUND

Current hot tub and spa designs include a rigid shell over a frame structure. Pumps, tubing, and machinery for the hot tub or spa is generally contained within available areas of the frame.

SUMMARY

Adjustable seating devices for a hot tub or spa are disclosed herein. In some embodiments, the disclosed adjustable seating devices include an upper body panel, an upper leg panel pivotably mounted to the upper body panel, and a lower leg panel pivotably mounted to the upper leg panel. In these and other embodiments, a pivot rod may connect the upper leg panel to the upper body panel. In some such embodiments, an arm may connect to the pivot rod and to a second pivot rod mounted to the hot tub. In these and other embodiments, a support may be pivotably attached to the upper body panel and the support may have a plurality of teeth engageable with the second pivot rod. In some embodiments, a control arm having a first end hingedly attached to a base of the hot tub and a second end attached to a pivot rod may join the lower leg panel and the upper leg panel. In these and other embodiments, an actuator may be positioned to move the control arm when engaged. The actuator, if present, may be an electric actuator. In some embodiments, the upper body panel is non-pivotably attached to the upper leg panel and the lower leg panel is non-pivotably attached to the upper leg panel, however, in other embodiments, the upper body panel is pivotably attached to the upper leg panel and the lower leg panel is pivotably attached to the upper leg panel. At least one of the lower leg panel, the upper leg panel, and the upper body panel may include one or more jets, if desired.

DETAILED DESCRIPTION

Adjustable seating devices for hot tubs, spas, whirlpool tubs, or other water-containing systems are provided herein. The adjustable seating devices disclosed herein may be used in connection with any suitable water-containing device, including but not limited to hot tubs, swim spas, and (indoor or outdoor) whirlpool tubs. For ease of description, the described devices and techniques are generally discussed with respect to use in a "hot tub" although it is to be understood that the present disclosure is not intended to be so limited.

In some example embodiments, the disclosed adjustable seating devices may adjust between at least two, at least three, at least four, or more positions. As described below in additional detail, the disclosed adjustable seating devices may include multiple panels (e.g., a head panel, upper body panel, upper leg panel, and/or a lower leg panel) that pivot with respect to one another to adjust a user's position. In other embodiments, however, the panels of the disclosed adjustable seating devices may be fixed relative to one another and may pivot with respect to the frame of the hot tub.

Hot tubs generally include plumbing, filtration, and circulation systems to manage the water contained therein. Many hot tub models also include jets that deliver streams of water and/or air with increased force to targeted areas. The systems used to recirculate, heat, and filter water are operated by mechanical and electrical systems that must be shielded from water. Accordingly, hot tub systems have been developed that include rigid fiberglass or acrylic shells that act as a barrier between the water and the power and electrical systems of the hot tub. Some such hot tub systems include portions shaped as seats, but these seats are rigid and immovable.

In accordance with some example embodiments, an adjustable seating device for use in a hot tub is disclosed. Example adjustable seating devices, as disclosed herein, may include multiple panels that move relative to one another and/or relative to the hot tub frame to adjust between positions. In some embodiments, one or more panels of the adjustable seating device may or may not include jets. In these and other example embodiments, the adjustable seating device may be adjusted manually, hydraulically, air-actuated, or electronically (for example, with a motorized device).

Figure 1:
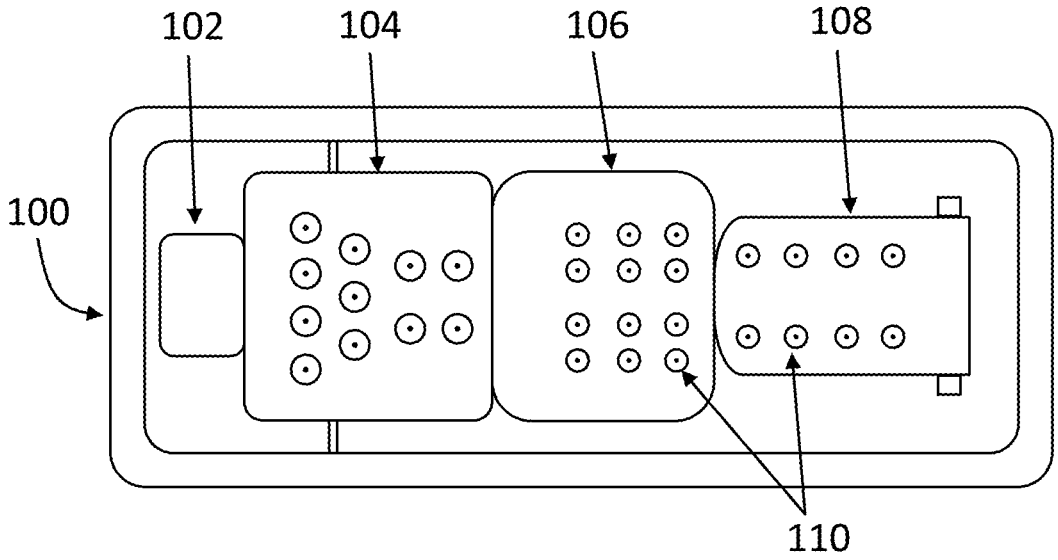
FIG. 1 shows a top view of an exemplary adjustable seating device, in accordance with some embodiments of the present disclosure.

Various example embodiments are illustrated in the Figures accompanying the subject application. Specifically, FIG. 1 shows a top view of an example adjustable seating device 100. As shown in FIG. 1, adjustable seating device 100 includes four distinct panels, namely, head panel 102, upper body panel 104, upper leg panel 106, and lower leg panel 108. In some embodiments, head panel 102 and upper body panel 104 may be a single panel. For example, upper body panel 104 may include an extension portion shaped as head panel 102. The example adjustable seating device 100 shown in FIG. 1 also includes jets 110 on panels 104, 106, and 108. It should be noted that, in some embodiments, panels 104, 106, and 108 may each be jetted or non-jetted. In some embodiments, adjustable seating device 100 may be included in a single-person hot tub, such as a single person whirlpool.

Figure 2:
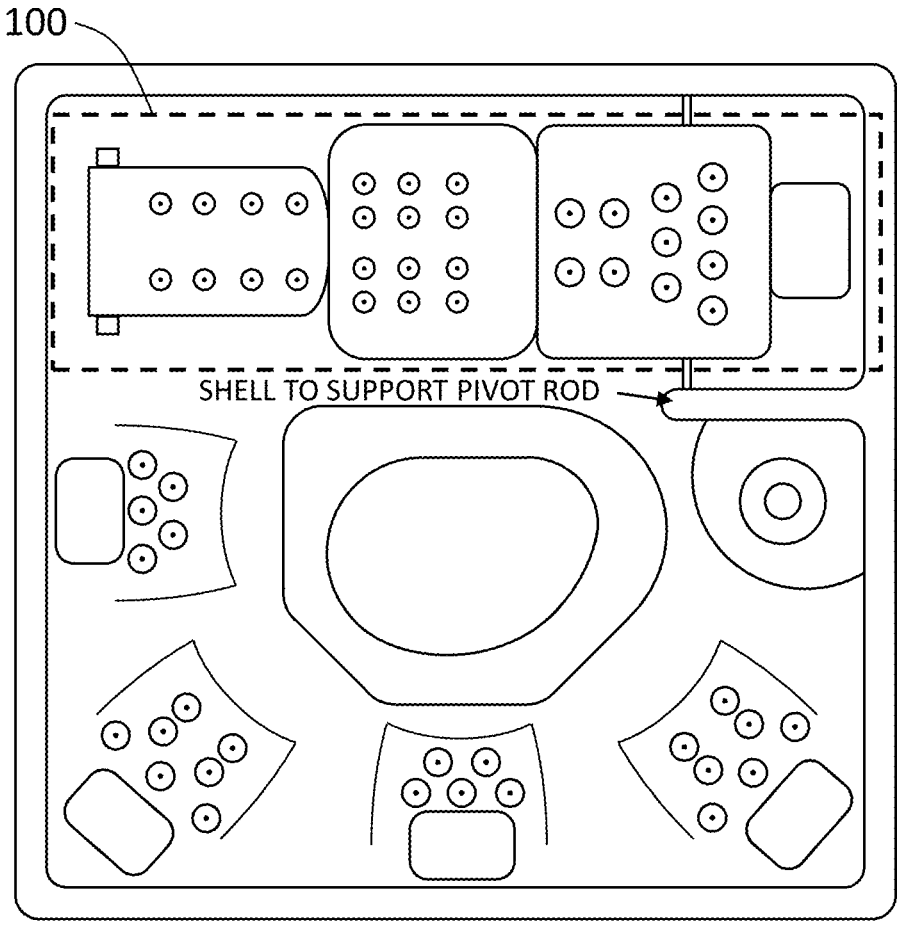
FIG. 2 shows a top view of a multi-person hot tub that includes an exemplary adjustable seating device, in accordance with some embodiments of the present disclosure.
Figure 3:
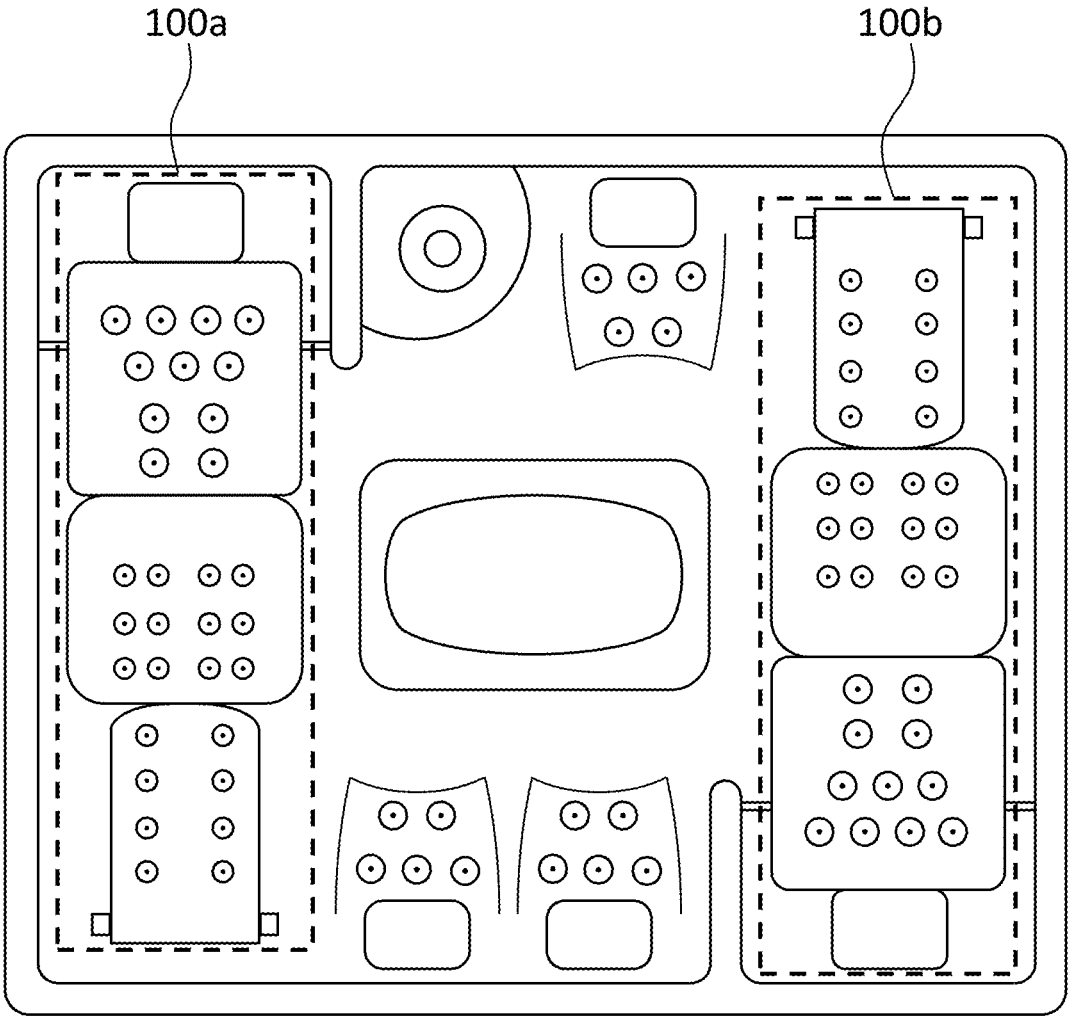
FIG. 3 shows a top view of a multi-person hot tub that includes two exemplary adjustable seating devices, in accordance with some embodiments of the present disclosure.

In some embodiments, a hot tub may include one, two, three, four, or more adjustable seating devices 100, as described herein. For example, FIG. 2 shows a top view of a multi-person hot tub that includes one adjustable seating device 100 and FIG. 3 shows a top view of a multi-person hot tub that includes two adjustable seating devices 100*a* and 100*b*. As shown in FIG. 3, adjustable seating devices 100*a* and 100*b* may be positioned on opposite sides of a hot tub and may, in some embodiments, face opposite directions. However, in some embodiments, adjustable seating devices 100*a* and 100*b* may face the same direction. In these and other embodiments adjustable seating devices 100*a* and 100*b* may be positioned on adjacent sides of a hot tub.

Figure 4:
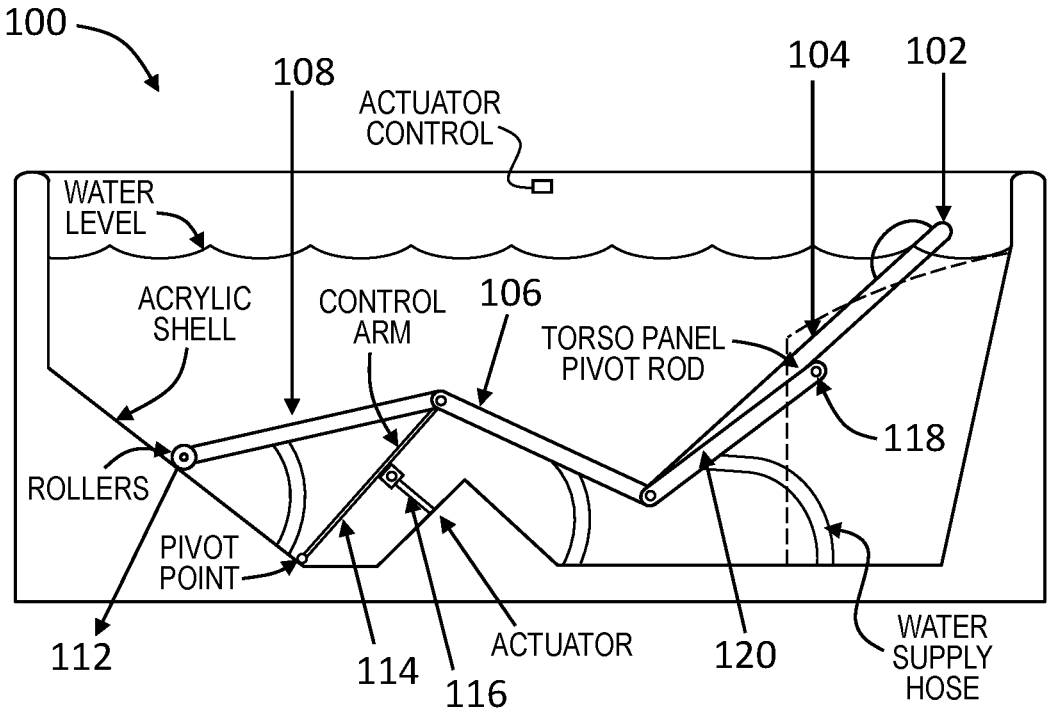
FIG. 4 is a side view of a schematic diagram of an exemplary adjustable seating device, in accordance with some embodiments of the present disclosure.

FIG. 4 is a side view of a schematic diagram of an adjustable seating device 100. As described in detail below, adjustable seating device 100 may adopt numerous positions, based on the orientation of panels 102-108 and the relative position of the panels in the hot tub. FIG. 4 illustrates adjustable seating device 100 in a lounger position, with head panel 102 and upper body panel 104 being in a partially reclined position. As shown in FIG. 4, head panel 102 and upper body panel 104 form an approximately 180° angle, upper leg panel 106 forms an angle greater than 90° with upper body panel 104, and lower leg panel 108 forms an angle greater than 180° with upper leg panel 106. The water level is illustrated in FIG. 4 and, as shown, the lounger position of adjustable seating device 100 allows all portions of the user's body except the head to be submerged in the hot tub's water.

In some example embodiments, the shell of the hot tub can be formed to complement the adjustable seating device 100. In particular, as shown in FIG. 4, the shell may include a ramp portion under at least a portion of the lower leg panel 108. In these and other embodiments, lower leg portion 108 may include one or more wheels 112 that may roll on the surface of the hot tub shell. In some embodiments, the hot tub shell may include one or more grooves to accommodate wheels 112. Wheels 112 may be attached to the bottom of lower leg panel 108 by any appropriate method, including with bolts, screws, or with a rod running through a portion of lower leg panel 108. In some embodiments, as the adjustable seating device 100 adjusts from a seated position to a lie down position, the overall shape of the device straightens and lengthens. In particular, as the end of the lower leg panel is pushed up the ramp/shell it may be raised accordingly. The angle of the hot tub shell underneath lower leg panel 108 is thus one factor that determines the vertical height of panel 108.

As will be described in additional detail below, adjustable seating device 100 may include a control arm 114 that contacts a fastener (e.g., a rod or a pivot rod) connecting lower leg panel 108 and upper leg panel 106. Control arm 114 may, in some embodiments, be hingedly connected to the floor or the base of the hot tub. An actuator 116 may be positioned to move control arm 114 when engaged. As shown in FIG. 4, the hot tub shell may include an angled region positioned under the actuator 116 so that the actuator 116 is positioned at an angle relative to the bottom of the hot tub shell. Actuator 116 may be any type of linear actuator, including but not limited to electric actuators. In other embodiments, however, the actuator may be manually adjustable. For example, the actuator may be an adjustable-length support, wherein multiple lengths of the support can be selected by the user as it is manually raised or lowered. In some embodiments, there may be a control accessible to a user to activate the actuator 116. An example actuator control is shown in FIG. 4, however, other placements of an actuator control are contemplated.

In some embodiments, a water hose may be connected to panel 102, 104, 106 and/or 108 to provide water and/or air to jets located in the panel. FIG. 4 illustrates water supply hoses that supply water to upper body panel 104, upper leg panel 106 and lower leg panel 108. In some embodiments, one hose supplies water to a particular panel, while in other embodiments, two or more supply water to a panel.

Figure 5A:
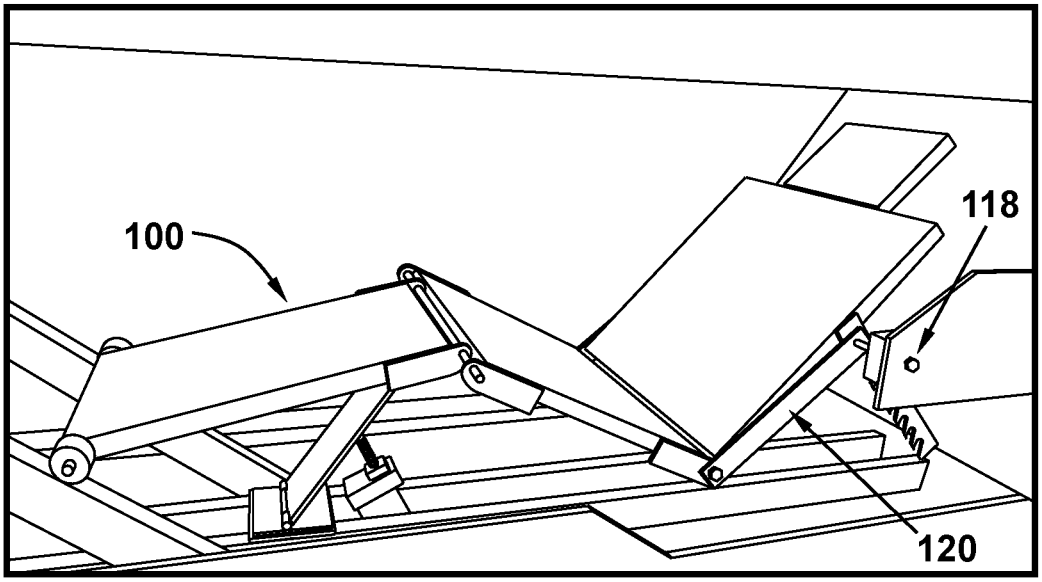
FIG. 5A is a photo of an exemplary adjustable seating device in a lounger position, in accordance with some embodiments of the present disclosure.
Figure 5B:
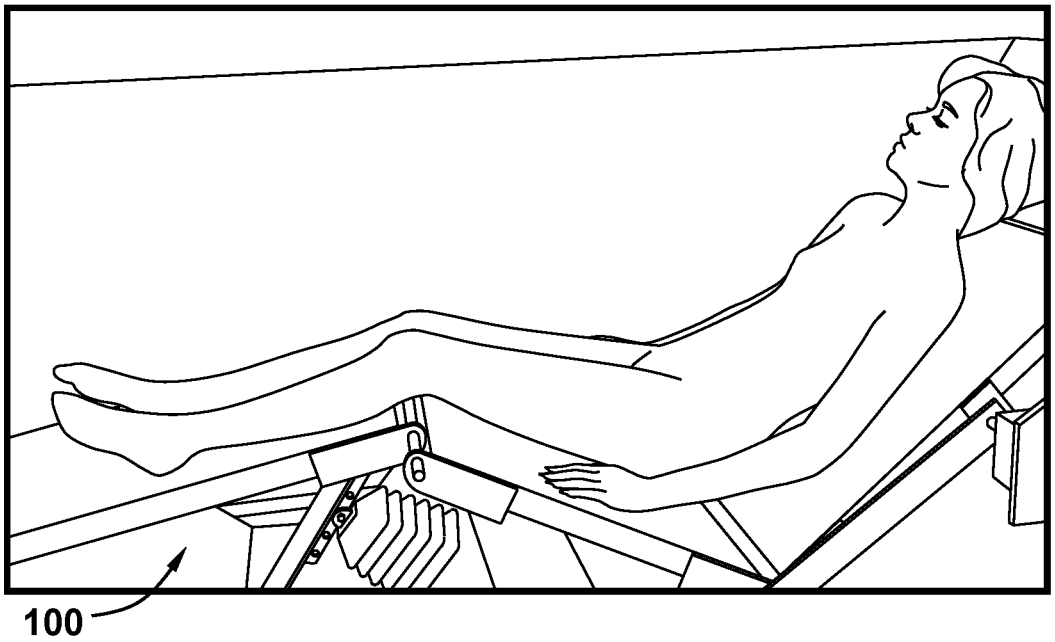
FIG. 5B is a photo of a user in the exemplary adjustable seating device of FIG. 5A.
Figure 5C:
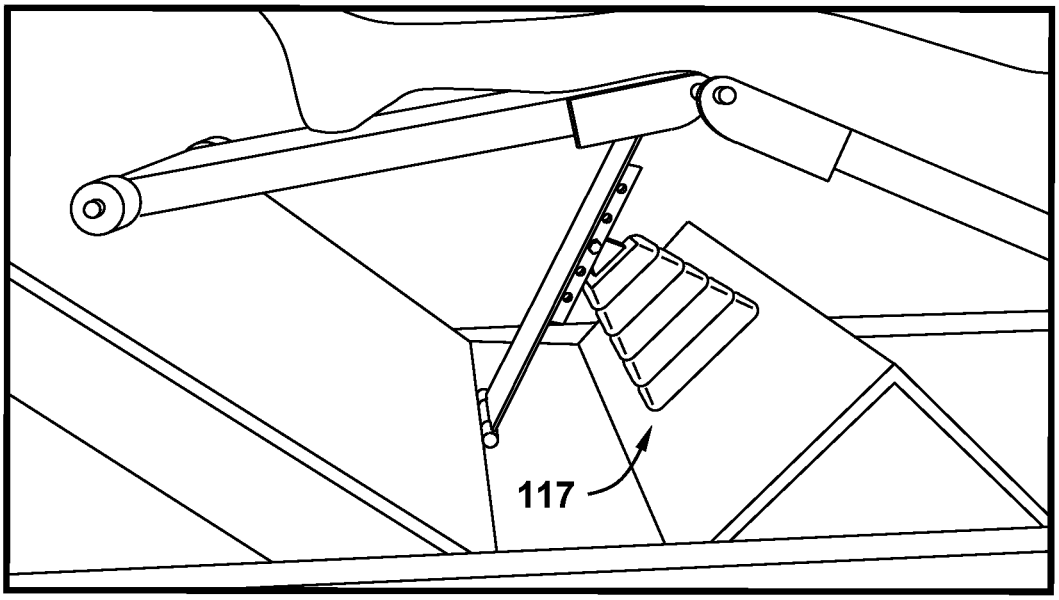
FIG. 5C is a close-up view of the exemplary adjustable seating device shown in FIGS. 5A and 5B.

In some embodiments, upper body panel 104 and head panel 102 may be supported by a pivot rod 118. Pivot rod 118 may be attached to the hot tub shell, in some example embodiments. Arm 120 may connect to pivot rod 118 and may also be connected to a rod joining upper body panel 104 and upper leg panel 106. In some embodiments, two arms 120 are attached to pivot rod 118 and a rod connecting upper body panel 104 and upper leg panel 106. In some such embodiments, arms 120 may be located on opposite sides of upper body panel 104. Pivot rod 118 may support upper body panel 104 (along with head panel 102, in some embodiments) and may allow upper body panel 104 and head panel 102 to rotate with respect to pivot rod 118. FIG. 5*a* is a photo of an example adjustable seating device 100 prototype in a lounger position. As can be seen in FIG. 5*a*, pivot rod 118 extends into the hot tub shell, in some example embodiments. FIG. 5*b* is a photo of a user in an example adjustable seating device 100 prototype in a lounger position. In some embodiments, actuator 116 may be covered by a boot that attaches to the actuator shaft and the hot tub shell to shield the actuator from water contained in the hot tub. FIG. 5*c* is a close-up view of a boot 117 surrounding actuator 116.

Panels 102-108 may be pivotably or non-pivotably attached to one another, in some example embodiments. For example, in some embodiments, lower leg panel 108 may be pivotably or non-pivotably attached to upper leg panel 106, upper leg panel 106 may be pivotably or non-pivotably attached to upper body panel 104, and upper body panel 104 may be pivotably or non-pivotably attached to head panel 102. In some embodiments, panels that are pivotably attached may be joined together using any suitable fastener. For example, in some embodiments, a bracket having an aperture may be attached to an outer side of each panel to be joined and a rod may be inserted through the apertures in the brackets to allow the panels to pivot with respect to one another. In other embodiments, connecting panels may be configured to be immovable or fixed with respect to one another (for example, by welding part of each connecting panel to a rod joining the panels together). Other suitable hinges or other pivoting or non-pivoting mechanisms may be used in other example embodiments.

Figure 6:
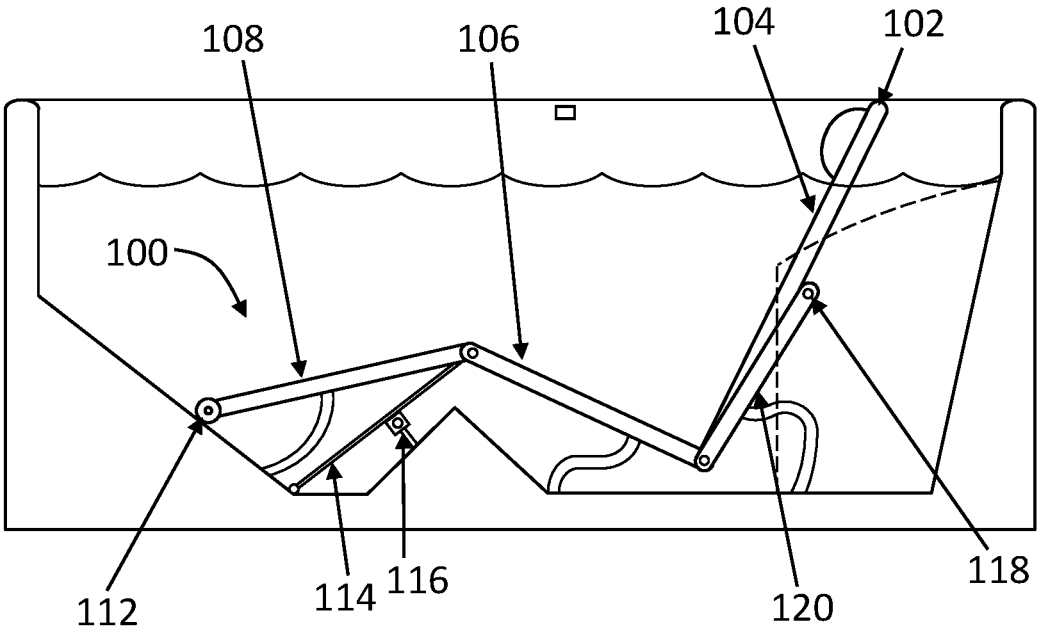
FIG. 6 is a schematic diagram of an exemplary adjustable seating device, in accordance with some embodiments of the present disclosure.
Figure 7A:
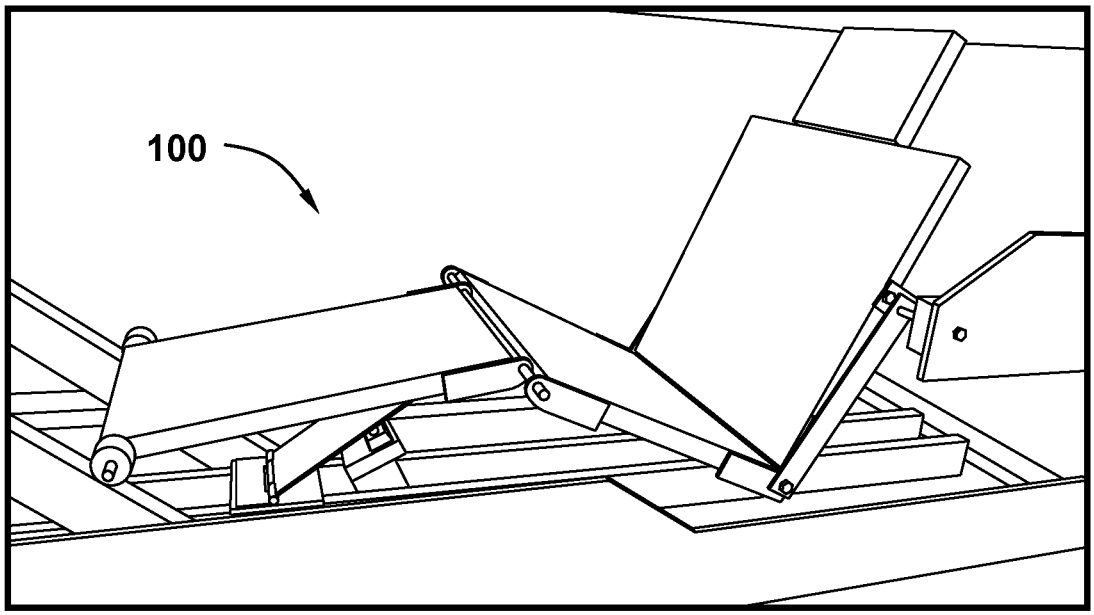
FIG. 7A is a photo of an exemplary adjustable seating device in a low upright seated position, in accordance with some embodiments of the present disclosure.
Figure 7B:
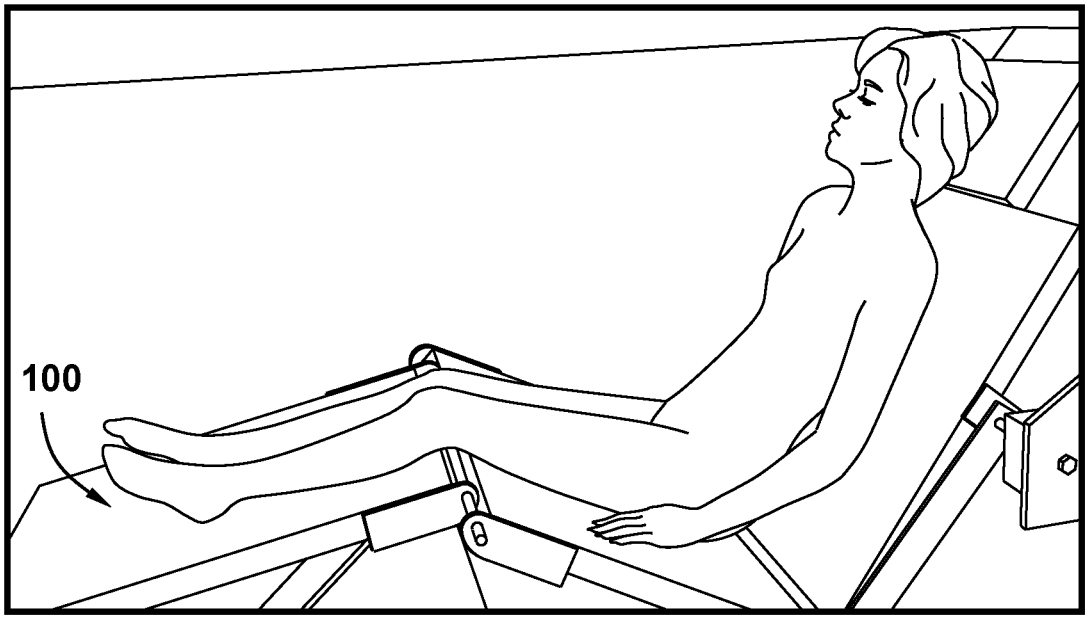
FIG. 7B is a photo of a user in the exemplary adjustable seating device of FIG. 7A.

FIG. 6 is a schematic diagram of an example adjustable seating device 100 in a low upright seated position. As shown in FIG. 6, head panel 102 and upper body panel 104 are positioned at approximately 180° to one another, upper body panel 104 and upper leg panel 106 form an approximately 900 angle, and upper leg panel 106 and lower leg panel 108 are positioned at an angle greater than 90° and less than 180°. From the lounger position illustrated in FIGS. 4 and 5, the low upright seating position shown in FIG. 6 may be achieved by lowering actuator 116 to bring upper leg panel 106 closer to a 90° angle with respect to upper body panel 104. FIG. 7*a* is a photo of an example adjustable seating device 100 prototype in a low upright seated position. FIG. 7*b* is a photo of a user in an example adjustable seating device 100 prototype in a low upright seated position.

Figure 8:
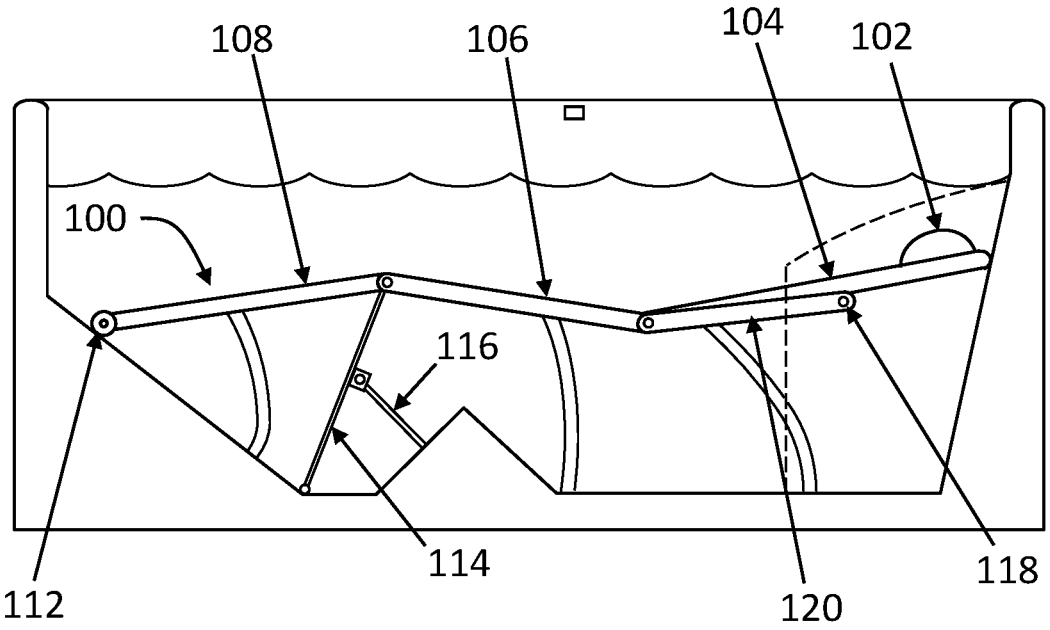
FIG. 8 is a schematic diagram showing an exemplary adjustable seating device, in accordance with some embodiments of the present disclosure.
Figure 9A:
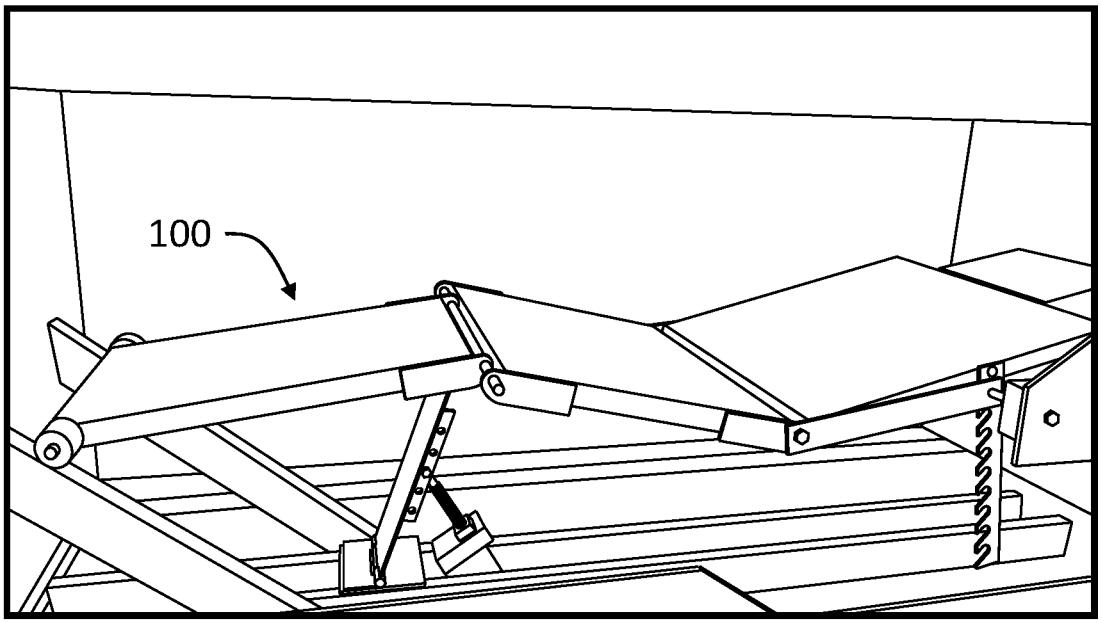
FIG. 9A is a photo of an exemplary adjustable seating device in a lie down position, in accordance with some embodiments of the present disclosure.
Figure 9B:
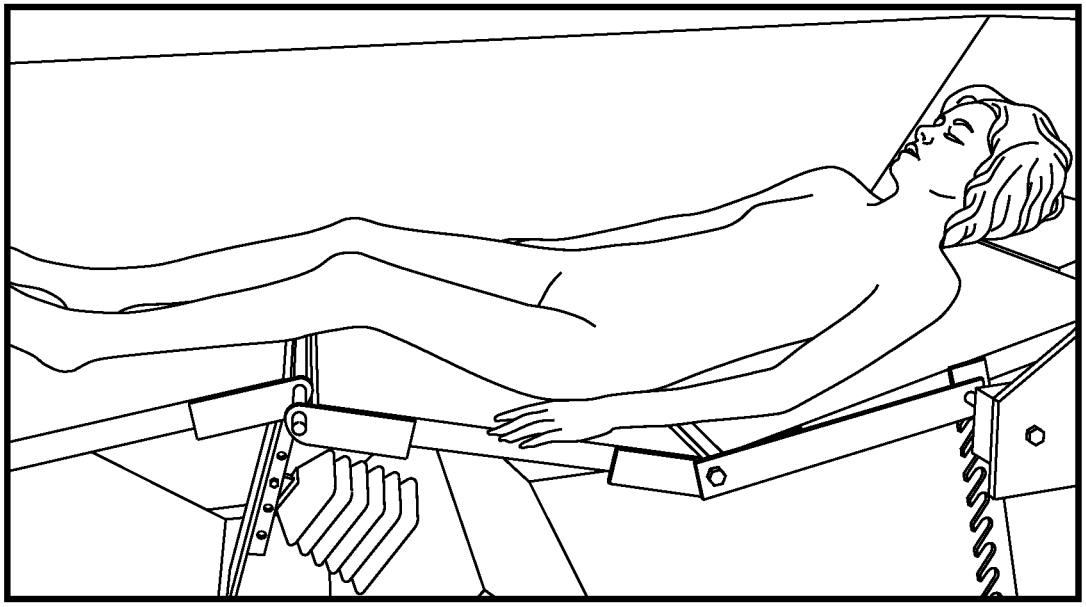
FIG. 9B is a photo of a user in the exemplary adjustable seating device of FIG. 9A.

FIG. 8 is a schematic diagram showing an example adjustable seating device 100 in a lie down position. To achieve a lie down position shown in FIG. 8 from the lounger position shown in FIGS. 4 and 5, actuator 116 can be increased to move control arm, which in turn moves a pivot rod connecting lower leg panel 108 and upper leg panel 106. In some embodiments, the water level in the hot tub may be adjusted so that some portions of a user's body (e.g., the head) are above water when the adjustable seating device 100 is in the lie down position. When in the lie down position, lower leg panel 108 may form an approximately 180° or greater angle with respect to upper leg panel 106, upper leg panel 106 may form a slightly less than 180° angle with upper body panel 104, and head panel 102 may form an approximately 180° angle with upper body panel 104. FIG. 9A is a photo of an example adjustable seating device 100 prototype in a lie down position. FIG. 9B is a photo of a user in an example adjustable seating device 100 prototype in a lie down position.

Figure 10:
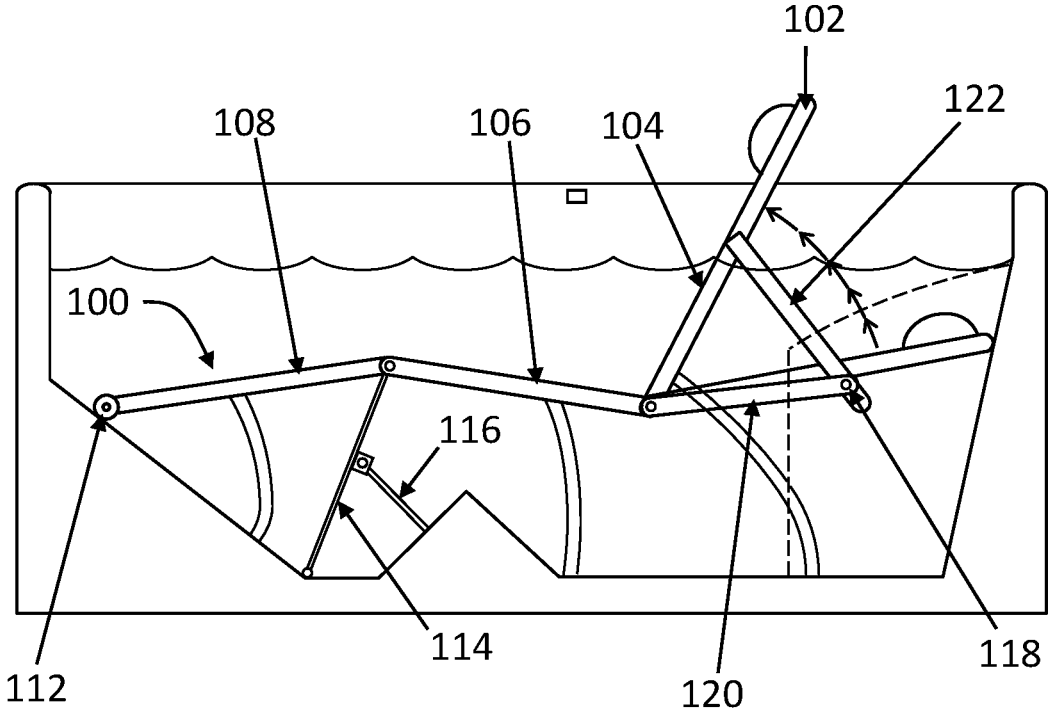
FIG. 10 a schematic diagram of an exemplary adjustable seating device in a cool down seat position, in accordance with some embodiments of the present disclosure.
Figure 11A:
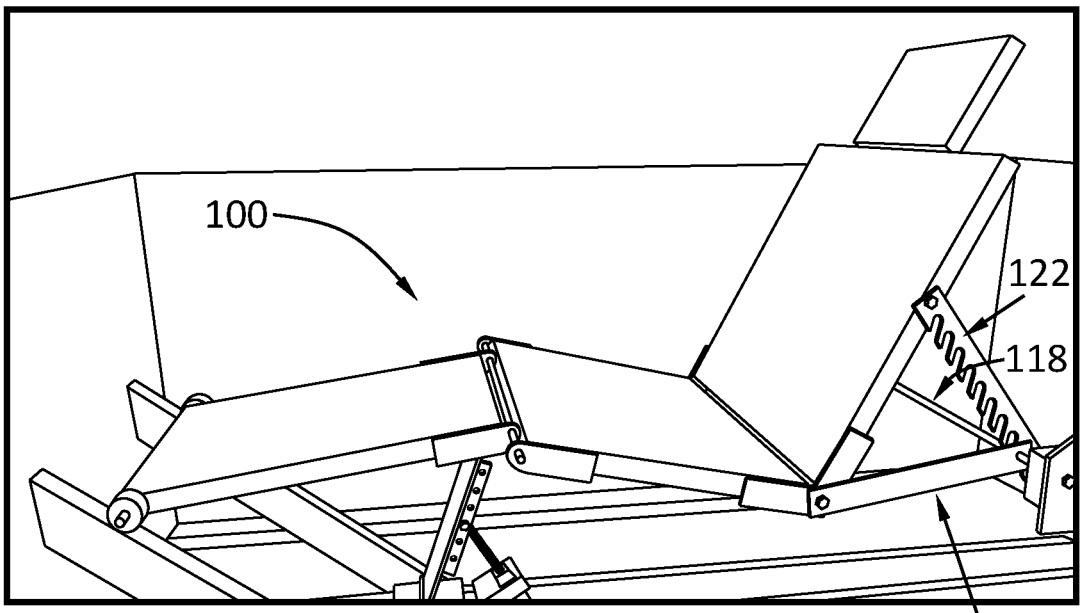
FIG. 11A a photo of an exemplary adjustable seating device in a cool down seat position, in accordance with some embodiments of the present disclosure.
Figure 11B:
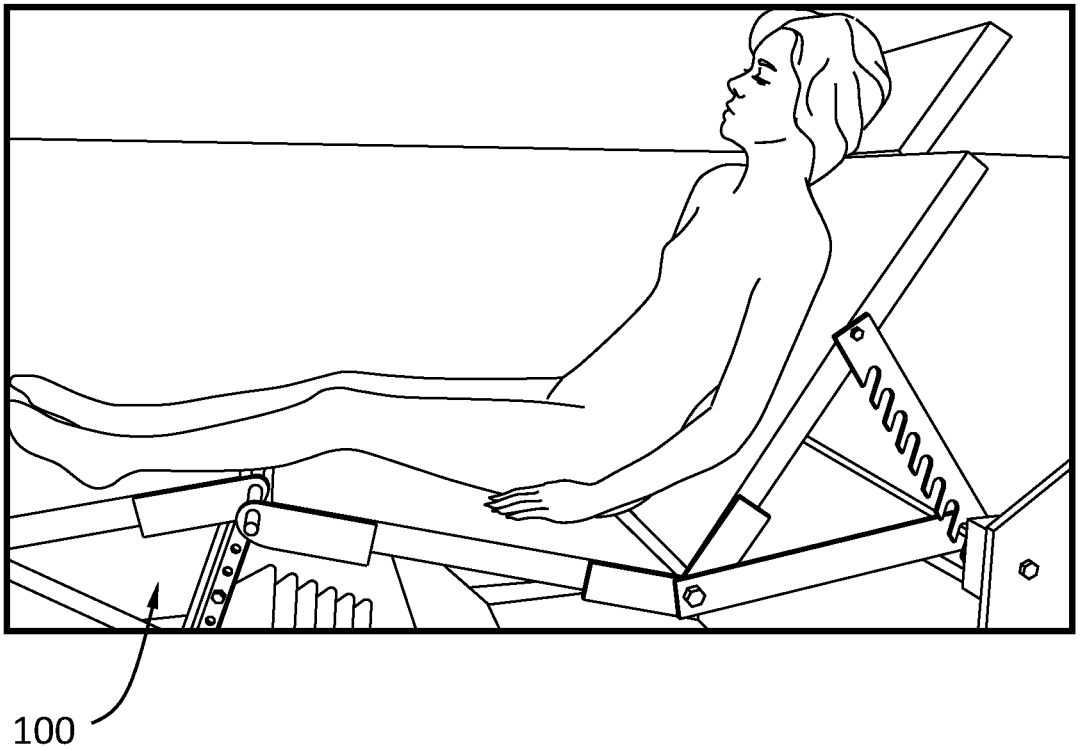
FIG. 11B is a photo of a user in the exemplary adjustable seating device of FIG. 11A.

FIG. 10 is a schematic diagram of an adjustable seating device 100 in a cool down seat position. To achieve the cool down seat position from the lie down position shown in FIGS. 8 and 9, upper body panel 104 (along with head panel 102) may be manually lifted by a user and secured in place with support 122. Support 122 may attach to pivot rod 118, in some example embodiments. In some embodiments, one or two supports 112 may be attached to upper body panel 104 (for example, on opposite sides of upper body panel 104). As shown in FIG. 11*a*, which is a photo of an example adjustable seating device 100 prototype in a cool down seat position, support 112 includes a plurality of teeth that are engageable with pivot rod 118 to secure upper body panel 104 (and head panel 102) in a fixed position. FIG. 11*b* is a photo of a user in an example adjustable seating device 100 prototype in a cool down seat position. When in a cool down seat position, the lower leg panel 108 may form an approximately 180° or greater angle with upper leg panel 106, upper leg panel 106 may form an angle of approximately 90° or slightly more with upper body panel 104, and head panel 102 may form an approximately 180° angle with upper body panel 104. As will be understood, upper body panel 104 (and head panel 102) may be positioned at numerous different positions by engaging selected teeth of support 122 with pivot rod 118. Additionally, adjustable seating device 100 may adopt any position between the positions illustrated in the Figures and described herein.

The disclosed adjustable seating devices 100 may be implemented with any suitable materials. For example, in some embodiments, stainless steel or another material having suitable structural integrity may be used as a frame for adjustable seating device 100. In these and other embodiments, a rigid or flexible polymeric material may be used to cover the frame of adjustable seating device, possibly with foam, cushion, or padding positioned between the adjustable seating device frame and covering material. Example covering materials include known water-impermeable polymeric materials, including vinyl, acrylic, and similar materials.

In addition to other benefits, the disclosed adjustable seating devices may, in some cases, reduce the chance of leak. For example, the adjustable seating devices described herein include between four and five penetrations in the shell, whereas standard lounge seat designs include between twenty and thirty penetrations. The less penetrations in the hot tub shell correlates to a reduced chance of harmful leakage.

The devices and techniques may be used for numerous purposes, such as for elderly users or users with decreased mobility and/or physical disabilities. For example, the functionality of adjusting between positions, including a cool down seat position where the user's torso is above the water line, may allow for increased ease entering and exiting a hot tub. Numerous configurations and variations will be apparent to one of skill in the art upon consideration of the subject disclosure. For example, in some embodiments, panels of the disclosed adjustable seating devices may be configured to move on a track formed in the hot tub while, in other embodiments, the panels may be configured to roll on a surface of the hot tub. In select embodiments, one or more panels of the disclosed adjustable seating devices may adjust with mechanical linkages, similar to the way a modern recliner is built. Generally speaking, any design for the disclosed adjustable seating devices may be selected in which a seat positioned inside a hot tub adjusts with respect to the hot tub.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes, and not to limit the scope of the inventive subject matter described herein. The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

What is claimed is:

1. A hot tub including at least one adjustable seating device comprising:

an upper body panel;

an upper leg panel pivotably mounted to the upper body panel, wherein a pivot rod connects the upper leg panel to the upper body panel; and a lower leg panel pivotably mounted to the upper leg panel.

2. The hot tub of claim 1 further comprising an arm connected to the pivot rod and to a second pivot rod mounted to the hot tub.

3. The hot tub of claim 2 further comprising a support pivotably attached to the upper body panel, the support having a plurality of teeth engageable with the second pivot rod.

4. The hot tub of claim 1 further comprising one or more wheels connected to a bottom portion of the lower leg panel.

5. The hot tub of claim 1, wherein at least one of the lower leg panel, the upper leg panel, and the upper body panel includes one or more jets.

6. The hot tub of claim 1 further comprising a control arm having a first end hingedly attached to a base of the hot tub and a second end attached to a pivot rod joining the lower leg panel and the upper leg panel.

7. The hot tub of claim 6 further comprising an actuator positioned to move the control arm when engaged.

8. The hot tub of claim 7, wherein the actuator is an electric actuator.

9. The hot tub of claim 1 further comprising at least two adjustable seating devices.

10. A hot tub having a frame and including at least one adjustable seating device comprising:

an upper body panel;

an upper leg panel mounted to the upper body panel; and a lower leg panel mounted to the upper leg panel, wherein the upper body panel is pivotably attached to the upper leg panel and the lower leg panel is pivotably attached to the upper leg panel and wherein the adjustable seating device is pivotably attached to the hot tub frame.

11. The hot tub of claim 10, wherein a rod connects the upper leg panel to the upper body panel.

12. The hot tub of claim 11 further comprising an arm connected to the rod and to a pivot rod mounted to the hot tub.

13. The hot tub of claim 12 further comprising a support pivotably attached to the upper body panel, the support having a plurality of teeth engageable with the pivot rod.

14. The hot tub of claim 10, wherein at least one of the lower leg panel, the upper leg panel, and the upper body panel includes one or more jets.

15. The hot tub of claim 10 further comprising a control arm having a first end hingedly attached to a base of the hot tub and a second end attached to a rod joining the lower leg panel and the upper leg panel.

* * * * *